United States Patent [19]

Johnson

[11] 4,435,138

[45] Mar. 6, 1984

[54] ROTARY VANE MACHINE WITH ROTATING END SEALING PLATES

[76] Inventor: Howard B. Johnson, Rte. 2, Box 172C, Adairsville, Ga. 30103

[21] Appl. No.: 196,853

[22] Filed: Oct. 20, 1980

[51] Int. Cl.[3] ..... F01C 1/00; F01C 19/00; F01C 19/08

[52] U.S. Cl. ..... 418/131; 418/147; 418/241; 418/254; 418/256

[58] Field of Search ..... 418/131, 147, 241, 253, 418/254, 256, 265

[56] References Cited

U.S. PATENT DOCUMENTS

| | | | |
|---|---|---|---|
| 280,221 | 6/1883 | Nash | 418/265 |
| 1,149,961 | 8/1915 | Shore | 418/147 |
| 2,590,728 | 3/1952 | Scognamillo | 418/256 |
| 3,832,105 | 8/1974 | Takahashi | 418/253 |

FOREIGN PATENT DOCUMENTS

| | | | |
|---|---|---|---|
| 114584 | 4/1918 | United Kingdom | 418/256 |

*Primary Examiner*—John J. Vrablik
*Attorney, Agent, or Firm*—Newton, Hopkins & Ormsby

[57] ABSTRACT

A tubular cylindrical housing encloses an eccentrically mounted rotor provided with radial slots receiving the inner ends of slideable vanes, the outer ends of which are connected to wiper bars which ride along the interior peripheral surface of the housing. Opposed rotatable sealing plates disposed between the ends of the rotor and the ends of the housing are concentric with the interior of the housing and carry the ends of the wiper bars. Gear trains synchronize the rotation of the discs and rotor.

10 Claims, 2 Drawing Figures

10
11
12
13
14
22
23
24
25
29a
29b
29c
29d
29e
29f
31
32
33
34
35
40
41
42
43
44
45
46
49
80a
80b
80c
81a
81b
81c
82a
82b
82c
83a
α
β
2
2

ROTARY VANE MACHINE WITH ROTATING END SEALING PLATES

BACKGROUND OF THE INVENTION

1. Field of the Invention

This invention relates to a rotary vane machine and is more particularly concerned with a machine which can be operated either as a rotary vane type pump or a rotary vane type motor.

2. Description of the Prior Art

In the past numerous rotary vane type pumps and rotary vane type motors have been devised. Such prior art devices usually included a cylindrical housing with an eccentrically mounted rotor therein, the rotor containing slots within which the vanes of the pump ride, the vanes being slung outwardly by centrifugal force so as to wipe along the inner periphery of the housing. With continued use, the ends of the rotor and the ends of the vanes become worn and permit the flow of water therearound, thereby causing a loss of volume and pressure for the pump or motor.

A search in the U.S. Patent and Trademark Office disclosed the following patents:

U.S. Pat. No. 2,278,131—Livermore
U.S. Pat. No. 2,435,279—Hubacker;
U.S. Pat. No. 2,499,763—Livermore;
U.S. Pat. No. 3,263,621—Eickmann;
U.S. Pat. No. 3,769,945—Kahre;
U.S. Pat. No. 3,976,408—Garrison.

Of those patents disclosed by the search, the patent to Hubacker, U.S. Pat. No. 2,435,279 is considered to have some pertinence since it disclosed annular side plates at the ends of the rotor. The patent to Eickmann, U.S. Pat. No. 3,263,621 also has significance in that it discloses floating blades or vanes. This patent also discloses an outer disc on the rotor.

SUMMARY OF THE INVENTION

Briefly described, the present invention includes a hollow cylindrical housing body having annular end plates and cup-like end caps retained together by tie rods. Within the cylindrical housing is a smaller cylindrical, eccentrically mounted, rotor which is tangential to the inner periphery of the housing body at one point. The rotor has circumferentially equally spaced vane carrying slots which open outwardly and receive a like number of paddle-like vanes. The inner and outer edges of these vanes are provided with cylindrically shaped bars so that the inner bars will ride within the slots and the outer bars will be received for limited pivotal movement in wiper bars which are carried between a pair of opposed complimentary sealing plates. These plates are respectfully disposed adjacent the outer ends of the rotor and are provided with sleeves which protrude outwardly through the central openings in the annular plates. Suitable bearings permit the sealing plates to rotate with respect to the annular plates and the rotor.

The end caps, which are disposed outwardly of the annular end plates, house gear trains by means of which the rotation of the rotor and the sealing plates are synchronized so that there is a one-to-one ratio, the sealing plates rotating one revolution as the rotor rotates one revolution. Trunion-like drive shafts on the ends of the rotor provide for driving the rotor or receiving power from the rotor, as the case may be, depending upon whether the machine is operated as a pump or as a motor.

A suitable inlet pipe and an outlet pipe provide for the travel of the fluid to and from the interior of the housing body.

Accordingly, it is an object of the present invention to provide a rotary vane machine which is inexpensive to manufacture, durable in structure and efficient in operation.

Another object of the present invention is to provide a rotary vane machine which is readily and easily disassembled and assembled so as to facilitate the replacement of parts.

Another object of the present invention is to provide a rotary vane machine which may function either as a pump or a motor.

Another object of the present invention is to provide a rotary vane machine which requires no packing glands and which will seat much of the high pressure areas, with pressure.

Another object of the present invention is to provide a rotary vane machine in which the gearing mechanism will be automatically lubricated by the hydraulic fluid.

Another object of the present invention is to provide a rotary vane machine which will permit essentially no flow of fluid past the sides of the vanes and motor.

Another object of the present invention is to provide a rotary vane machine which will reduce the friction of the moving parts and better seal the shaft and the vanes from leakage.

Another object of the present invention is to provide a positive displacement rotary vane type machine which will reduce the likelihood that the traveling vanes will be stuck in a retracted position which will permit the loss of fluid.

Another object of the present invention is to provide a rotary vane machine which will reduce the relative movement of the vanes and will tend to eliminate the binding of the vanes, due to internal pressure.

Another object of the present invention is to provide to rotary vane machine which will reduce the friction on the outer edges of the vane as the machine is operated.

Another object of the present invention is to provide a rotary vane machine which can be operated at high speed.

Other objects, features and advantages of the present invention will become apparent from the following description when taken in conjunction with the accompanying drawings wherein like characters of reference designate corresponding parts.

DESCRIPTION OF THE PREFERRED EMBODIMENT

Figure 1:
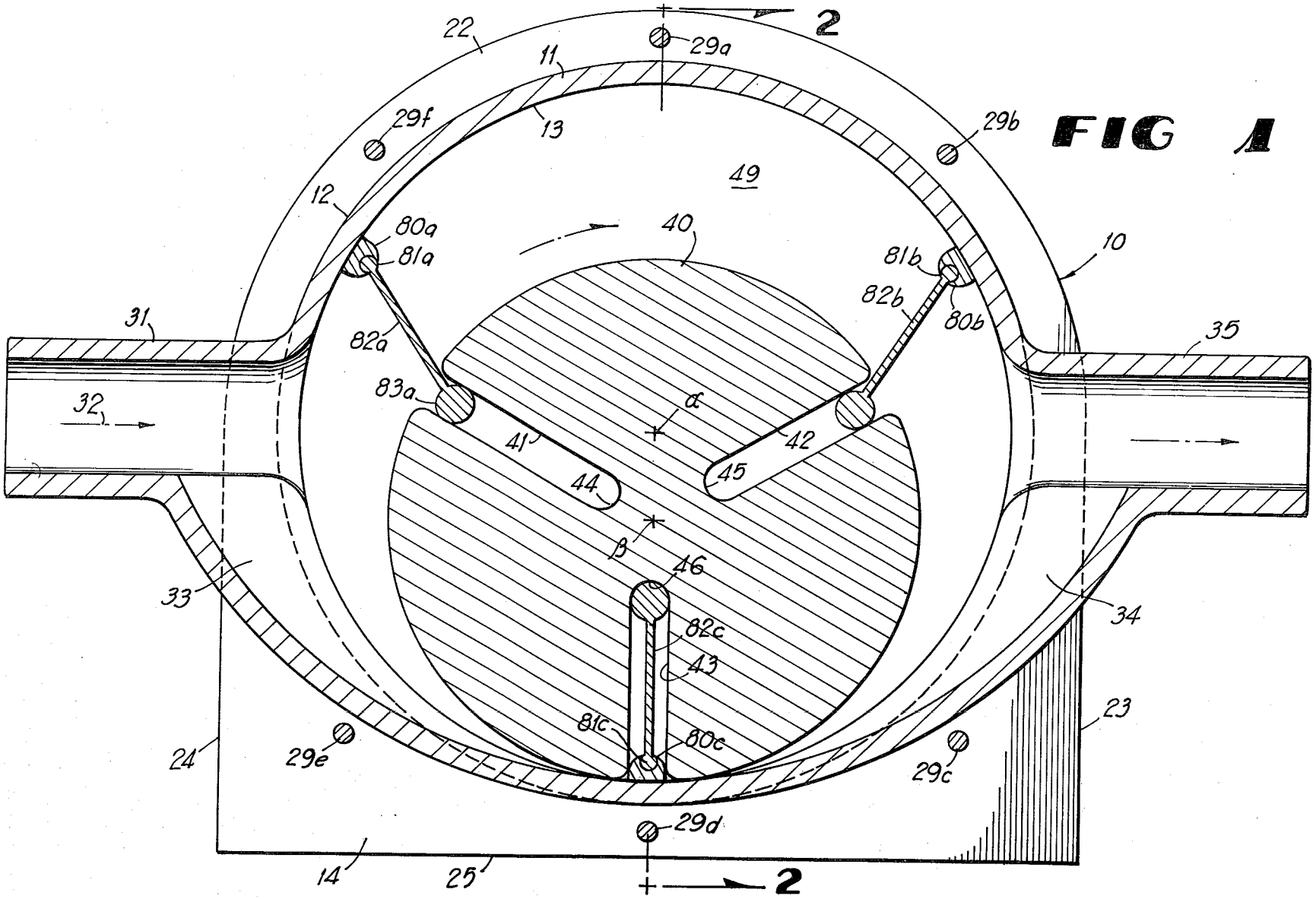
FIG. 1 is a vertical sectional view of a rotary vane machine constructed in accordance with the present invention.

Referring now in detail to the embodiment chosen for the purpose of illustrating the present invention, numeral 10 denotes generally an outer housing for the rotary vane machine. This outer housing includes a hollow, tubular, right, cylindrical, housing body 11 having a cylindrical outer peripheral surface 12 and a cylindrical inner peripheral surface 13, concentric with each other. A pair of annular flat parallel end 14 and 15 plates sandwich the body 11, therebetween. The end plate 14 is provided with a circular groove 16 which receives one end of the body 11 while the end plate 15 is provided with a complementary annular groove 17. Thus, the end plates 14 and 15 are opposed flat parallel complementary members disposed perpendicular to the longitudinal axis A of the body 11.

Outwardly of the end plates 14 and 15, the housing 10 is provided with a pair of opposed complementary cup-like caps 18 and 19 which have semi-cylindrical upper edges or surfaces 20 and 21 which are concentric and aligned with the outer surfaces 22 and 23 of the end plates 14 and 15 and are also concentric with the peripheral surfaces 12 and 13 of the housing body 11 about axis $\alpha$. The diameter of the upper peripheral surfaces 20, 21, 22 and 23 are the same and are of larger dimensions than the outside diameter of the housing body 11. The lower portions of the end plates 14 and 15 and the caps 18 and 19 protrude well below the lower periphery of the housing body 11 so as to be provided with forward and rear edges, such as forward edge 23 and rear edge 24, which are vertically disclosed and parallel to each other, merging tangentially with the forward portion and rear portion of edge 22. The lower edges 25 and 26 of the end plates 14 and 15 and the lower edges of the end caps 18 and 19 are straight and are disposed in a common horizontal plane so as to provide a base on which the housing 10 can rest. Circumferentially spaced tie bars 29*a*, 29*b*, 29*c*, 29*d*, 29*e* and 29*f* extend through the end caps 18 and 19 and the end plates 14 and 15 so as to pass outwardly adjacent the outer surface 12 of the housing body 11. The ends of the bolts 29*a*, 29*b*, 29*c*, 29*d*, 29*e* and 29*f* are externally threaded and provided with nuts, such as nuts 30*a* and 30*d*, seen in FIG. 2. Thus, the housing 10 can be readily disassembled and assembled, as desired.

Integrally joined to the entrance end of the housing body 11 is a cylindrical inlet pipe 31, the inner end of which communicates with the interior of housing 10 and through which fluid is fed in the direction of the arrow 32 into the chamber or hollow interior of the housing 10. The lower portion of the inlet pipe 31 is deformed downwardly and merges with a U-shaped inwardly opening trough 33 formed integrally with the cylindrical housing body 11, the trough 33 extending downwardly and forwardly and tapering to a tip at the lower periphery of the housing body 11. In like fashion, the forward portion of the housing body 11 is provided with a central trough 34 which tapers downwardly from a discharge pipe 35 to essentially a point, the trough 34 being complementary with the trough 33. The function of the troughs 33 and 34 will be described hereinafter.

The intake or inlet pipe 31 and the discharge pipe 34 are disposed centrally on opposite sides of the housing body 11, the axes of these pipes 31 and 35 being in alignment and intersecting the central transverse axis $\alpha$ of the housing 10.

Disposed within the interior of the housing 10 is a rotor 40 which is a solid, right cylindrical member having a central transverse axis $\beta$ and a plurality of axially extending outwardly opening circumferentially equally spaced vane receiving slots 41, 42 and 43. In the present embodiment the three slots 41, 42 and 43 are circumferentially spaced from each other by 120°. Of course, as many slots as desired may be employed as will be obvious to those skilled in the art. The lower or inner ends of the slots 41, 42 and 43 are concave at numerals 44, 45 and 46.

The diameter of the rotor 40 is substantially less than the inside diameter of the housing body 11 and the axis $\beta$ of the rotor 40 is disposed vertically below the axis $\alpha$ of the periphery or inside surface 13 so that the lower periphery of the rotor 40 tangentially engages the lower periphery of surface 13. The slots 41, 42 and 43 extend throughout the transverse length of the rotor 40.

The rotor 40 has opposed ends 47 and 48 which terminate inwardly of the inner surfaces of the plates 14 and 15. According to the present invention, flat annular sealing plates 49 and 50 are disposed in the interior of the housing 12, the plate 49 being disposed between the end 47 and the end plate 14 and plate 50 being disposed between the end 48 and the inner surface of end plate 15. The plates 49 and 50 are complementary members, each being a circular flat plate of approximately the same diameter as the inside diameter of the housing body 11 along surface 13. The plates 49 and 50 are annular, having integrally formed therewith outwardly protruding central sleeves 51 and 52. Sleeves 51 and 52 are in transverse alignment, being opposed, hollow, cylindrical, tubular members which protrude outwardly through the central openings in the plates 14 and 15, respectively. Roller bearings 53 and 54 received on the outer peripheries of the sleeves 51 and 52 and are received in the central openings of the plates 14 and 15 for journalling the sleeves 51 and 52 for rotation about the axis $\alpha$. The sleeves 51 and 52 protrude outwardly beyond the bearings 53 and 54 and beyond the outer surfaces of the end plates 14 and 15 and the sleeves are respectively provided with gears 55 and 56 which are disposed within the cavities 57 and 58 formed by in the caps 18 and 19. One of the functions of the plates 49 and 50 is that they seat with fluid pressure against the inner surfaces of end plates 14 and 15 to seal the hydraulic fluid from leakage therebetween.

Figure 2:
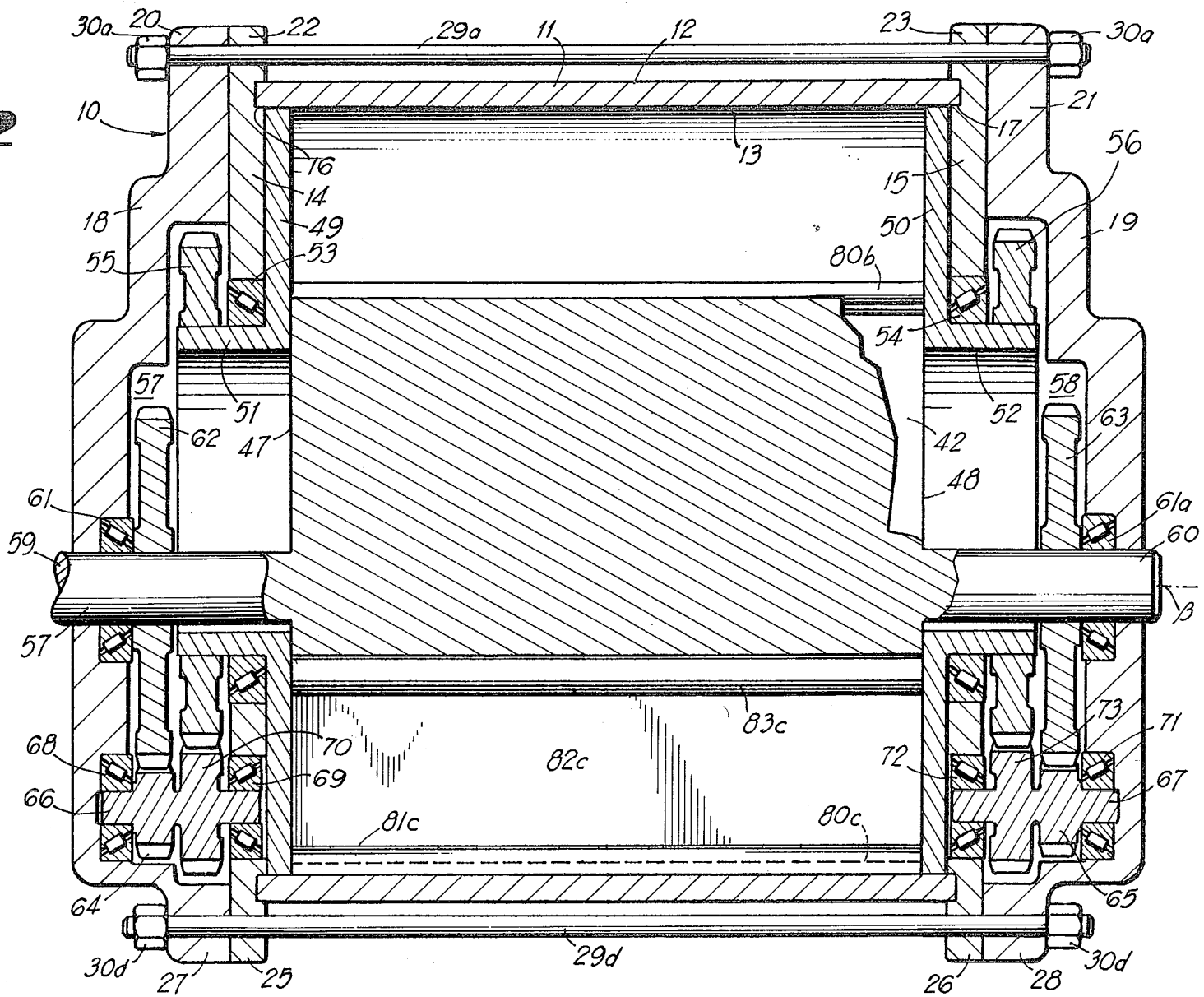
FIG. 2 is a cross-sectional view taken substantially along line 2—2 in FIG. 1.

The ends 47 and 48 of the rotor 40 are provided with outwardly protruding trunions or stub shafts 59 and 60 which protrude outwardly in oppposite directions along the axis $\beta$, the inside diameters of the sleeves 51 and 52 being sufficiently large that the shafts 59 and 60 protrude through the bottom portions of these sleeves as seen in FIG. 2. Bearings 61, 61*a* mounted in appropriate recesses in the inner surfaces of the cup-shaped caps 18 and 19 journal the end portions of the shafts 57 and 58, respectively. The shafts, 58 and 59 protrude through appropriate openings to terminate outwardly of the caps 18 and 19 and shaft 57 is provided with appropriate drive mechanism (not shown) by which the rotor 40 can be rotated, in the event that the machine is operated as a pump or can provide power, in the event that the machine 10 is operated as a motor.

Inwardly of the bearings 61 and 61*a* are a pair of gears 62 and 63, respectively. Gear 62 and 63 mesh respectively along their lower peripheries with gears 64 and 65 which are disposed respectively on shafts 66 and 67. The shaft 66 is journaled by bearings 68 and 69, located respectively in a recess in the lower portion of cap 18 and in the end plate 14. A second gear 70 on shaft 66 meshes with the gear 55, the ratio of the gear train which includes gears 55, 70, 64 and 62 being such that upon each revolution of the shaft 57, the sleeve 51 will be rotated one revolution. In like fashion at the opposite end of the housing 10, the shaft 67 is journaled by bearings 71 and 72 respectfully in the recess portion of the cap 19 and the end plate 15, the shaft 67 being provided with a gear 73 which meshes with the gear 56 so as to provide the same 1:1 ratio for the shaft 58 and the sleeve 52. It is therefore seen that with this gear train, each revolution of the shafts 59 and 60, causes the sleeves 51 and 52 to rotate one revolution, in synchronization.

Referring now to the sealing plates 49 and 50, it will be seen that the outer surface of plates 49 and 50 are closely adjacent to the inner surfaces of the end plates 14 and 15 so that under pressure, the plates 49 and 50 tend to be respectively seated against the inner surfaces of the plates 14 and 15.

Extending between the inner surfaces of the plates 49 and 50, adjacent the peripheries thereof, are a plurality of vane retaining wiper rods or bars 80*a*, 80*b* and 80*c*. Each bar 80*a*, 80*b*, or 80*c* has an outer surface which conforms to the curvature of the inner peripheral surface 13 of the housing body 11 so as to wipe therealong as the plates 49 and 50 are rotated. Each of the bars 80*a*, 80*b* and 80*c* is of a width approximately equal to the widths of slots 41, 42 and 43 respectively so that, as the periphery of the rotor 40 becomes tangential with the surface 13, that bar 80*a*, 80*b* and 80*c* will be received within the outer end portion of the vane slot 41, 42 or 43, as the case may be. The inner portion of each bar 80*a*, 80*b* and 80*c* is crescent-shaped, being provided with a cylindrical recess which extends in excess of 180° so as to receive the outer cylindrical end 81*a*, 81*b* or 81*c* of the vanes 82*a*, 82*b* and 82*c*.

The vanes 82*a*, 82*b* and 82*c* are each identical, being flat usually rigid, rectangular members, the outer ends of which are fixed to the periphery of rods 81*a*, 81*b* and 81*c* which are journaled for limited pivotal movement by the recesses of bars 80*a*, 80*b* and 80*c*, respectively. The inner ends of the vanes 82*a*, 82*b* and 82*c* are provided with rod-like slide bars 83*a*, 83*b* and 83*c* which extend transversely parallel to the outer bars 81*a*, 81*b* and 81*c* throughout the length of the slots 41, 42 and 43. The diameters of the slide rods 83*a*, 83*b* and 83*c* are approximately equal to the width of the slots 41, 42 and 43 so that the slide bars 83*a*, 83*b* and 83*c* slide within the confines of the slots 41, 42 and 43 inwardly and outwardly as the rotor 40 is rotated, the bars 83*a*, 83*b* and 83*c* approaching their outermost limit of travel in their slot 41, 42 or 43 at the upper portion of the housing 10 and being fully retracted or inserted into the slot 41, 42 or 43, as the case may be when the rotor 40 is at the lowest portion of the housing 10.

The vanes 82*a*, 82*b* and 82*c* are substantially thinner than the diameter of the rods 83*a*, 83*b* and 83*c* and, therefore, can clear the peripheral end portions of the rotor 40 which define the associted slot 41, 42 or 43, without causing any appreciable flexing of the rotor vane 82*a*, 82*b* or 82*c*. On the other hand, substantially high volumes of liquid or fluid can be displaced by these vanes since they are firmly fixed through the wiper bars 80*a*, 80*b* and 80*c* against shifting or binding at their outer end portion. Furthermore, the rods 83*a*, 83*b* and 83*c* fix the inner ends of the vanes within the slots 41, 42 and 43. Since the slots 41, 42 and 43 are open to the relatively low pressure area of the sleeves 51 and 52, there is no appreciable build up of pressure behind each of the rods 83*a*, 83*b* and 83*c* as they move inwardly within the slots 41, 42 and 43.

The troughs 33 and 34 enable the pumping chambers or compartments defined between adjacent vanes, which are progressively enlarged and then decreased in size, as the rotor 40 and the plates 49 and 50 are rotated enable all of the fluid or liquid to be drawn into the particular segmented chamber and then expelled therefrom without any undue pulling of a vacuum or creating of unvented pressure.

The hydraulic fluid which is usually in the form of hydraulic oil which will be pumped through the machine will, to a very limited extent, leak past the seals provided by the inner rods 83*a*, 83*b* and 83*c* and, thence, through the sleeves 51 and 52 and into the cavity area 57 and 58 of the end caps 18 and 19 so as to collect in the lower portions of the cavities 57 and 58 and provide lubrication for the gears 64, 65 70 and 73 which in turn will transmit the hydraulic fluid to the gears 55, 56, 62 and 63. Such lubrication will also be imparted to the various bearings 53, 54, 61, 61*a*, 68, 69, 71 and 72.

Since there is only limited rocking action between the ends 47 and 48 of rotor 40 and the plates 49 and 50, there will be no appreciable wear to these elements. The pressure build up as the fluid is compressed by the vanes or because the fluid is under pressure when it is received in the housing chamber, the plates 49 and 50 tend to be seated so as to arrest outward flow of the fluid while the plates 49 and 50 rotate within the housing.

The wiper bar rods 80*a*, 80*b* and 80*c* are held by plates 49 and 50 in their fixed positions, passing against the inner peripheral surface 13.

In the present embodiment, the rods 80*a*, 80*b* and 80*c* are equally spaced circumferentially from each other so as to be located 120° apart. If desired, the body of each vane 82*a*, 82*b* or 82*c* is semi-rigid and can be formed of flexible material, such as sheet metal or plastic, so as to permit flexing, within its elastic limits, as the vane passes from a position aligned in the slot, as shown for vane 82*c*, to an angled position with respect to the axis of the slot as shown for vanes 82*a* and 82*b* in FIG. 1. Since the narrow vanes do not ride directly against a portion of the housing 10, the ends of the vanes 80*a*, 80*b* and 80*c* do not wear appreciably but simply shift slightly as they rest against the inner surfaces of the plates 49 and 50.

It will be obvious to those skilled in the art that many variations may be made in the embodiment here chosen for the purpose of illustrating the present invention without departing from the scope thereof as defined by the appended claims.

I claim:

1. A rotary vane machine of the type having a housing with end plates and a body therebetween having a peripheral inner surface concentric about a transverse axis and defining an interior, an inlet means communicating with said interior for conducting fluid into said interior, an outlet means communicating with said interior at a point spaced circumferentially from said inlet means with respect to said inner surface for conducting fluid from said interior, a rotor eccentrically mounted in said interior for rotation about a second transverse axis parallel to said first axis, said rotor being provided with circumferentially spaced vane receiving slots therein and vanes received respectively in said slots, said vanes being movable in said slots and extending outwardly therefrom, wherein the improvement comprises:

(a) a pair of opposed sealing plates disposed respectively between one of said end plates and the end of said rotor, each of said sealing plates having a larger radial dimension than said rotor for seating with fluid pressure against the inner surface of said one of said end plates to retard leakage of fluid therebetween; and (b) circumferentially spaced wiper bars connected to and extending between said plates and riding against said peripheral inner surface and connected to the outer ends of said vanes.

2. The rotary vane machine defined in claim 1 wherein the sealing plates are in opposed parallel radially disposed relationship and are of diameters slightly less than the diameter of said inner surface.

3. The rotary vane machine defined in claim 1 including means interconnected between said rotor and the sealing plates for rotating the end plates in synchronization with the rotation of said rotor so that said end plates rotate one revolution as said rotor rotates one revolution.

4. The rotary vane machine defined in claim 1 wherein said end plates are provided with central openings and wherein said sealing plates are annular members and including sleeves connected to the inner peripheries of said sealing plates and protruding through said central openings in said end plates, said sleeves having aligned openings therein, trunions on the ends of said rotor protruding through the opening of said sleeves and journalled by said housing, the ends of said rotor extending over the openings of said sleeves.

5. The rotary vane machine defined in claim 1 wherein the ends of said vanes are pivotally connected to said wiper bars.

6. The rotary vane machine defined in claim 1 including means for simultaneously rotating said sealing plates and said rotor, said sealing plates being rotatable about said first axis and said rotor being rotatable about said second axis.

7. The rotary vane machine defined in claim 1 wherein said wiper bars have outer surfaces which conform to the curvature of said inner surface of said housing and wipe along said inner surface as said sealing plates are rotated.

8. The rotary vane machine defined in claim 1 wherein the inner ends of said vanes are provided with cylindrical bars which ride within said slots, the diameters of said cylindrical bars being greater than the thickness, respectively, of said vanes.

9. The rotatable vane machine defined in claim 8 wherein the pivotal connection of said vanes and said wiper bars including transverse bars extending along the outer edge portion of said vanes, respectively, said wiper bars including crescent shaped surfaces receiving respectively said transverse bars.

10. A rotary vane machine of the type having a housing with end plates and a body therebetween having a peripheral inner surface concentric about a transverse axis and defining an interior, and inlet means communicating with said interior for conducting fluid into said interior, an outlet means communicating with said interior at a point spaced circumferentially from said inlet means with respect to said inner surface for conducting fluid from said interior, a rotor eccentrically mounted in said interior for rotation about a second transverse axis parallel to said first axis, said rotor being provided with circumferentially spaced vane receiving slots therein and vanes received respectively in said slots, said vanes being movable in said slots and extending outwardly therefrom, wherein the improvement comprises:

(a) a sealing plate disposed between one of said end plates and the end of said rotor, said sealing plate having a larger radial dimension than said rotor for seating with fluid pressure against the inner surface of said one of said end plates to retard leakage of fluid therebetween;

(b) a second sealing plate disposed between the other of ssaid end plates and the other end of said rotor and also having a larger radial dimension than said rotor for seating with fluid pressure against the inner surface of said other of said end plates to retard leakage of fluid therebetween;

(c) means interconnected between said rotor and the sealing plates for rotating the end plates in synchronization with the rotation of said rotor so that said end plates rotate one revolution as said rotor rotates one revolution;

(d) said sealing plates being eccentrically mounted with respect to said rotor and the means synchronizing the rotation of the sealing plates and said rotor include gear trains connected between said sealing plates and said rotor.

* * * * *